US009777991B1

(12) United States Patent
Guelli

(10) Patent No.: US 9,777,991 B1
(45) Date of Patent: Oct. 3, 2017

(54) RIFLE SCOPE PROTECTIVE COVERING

(71) Applicant: Sam Guelli, Fall Branch, TN (US)

(72) Inventor: Sam Guelli, Fall Branch, TN (US)

( * ) Notice: Subject to any disclaimer, the term of this patent is extended or adjusted under 35 U.S.C. 154(b) by 0 days.

(21) Appl. No.: 15/261,344

(22) Filed: Sep. 9, 2016

(51) Int. Cl.
*F41G 1/38* (2006.01)

(52) U.S. Cl.
CPC ..... *F41G 1/383* (2013.01); *F41G 1/38* (2013.01)

(58) Field of Classification Search
CPC ..... F41G 1/383
USPC ..... 42/96, 129; 206/317; 224/243
See application file for complete search history.

(56) References Cited

U.S. PATENT DOCUMENTS

| | | | | |
|---|---|---|---|---|
| 2,889,629 | A | 6/1959 | Darkenwald | |
| 2,968,099 | A | 1/1961 | Peters, Jr. | |
| 2,972,190 | A | 2/1961 | Vissing | |
| 3,831,285 | A | 8/1974 | Vissing | |
| 5,150,528 | A | 9/1992 | Shire | |
| 5,183,953 | A | 2/1993 | Anderson | |
| 5,495,676 | A | 3/1996 | Chesnut et al. | |
| 5,566,490 | A | 10/1996 | Owen | |
| 5,850,706 | A * | 12/1998 | Evans | G02B 27/0006 150/154 |
| D423,629 | S * | 4/2000 | Granger | D22/100 |
| D445,475 | S | 7/2001 | Spear | |
| 6,862,833 | B1 * | 3/2005 | Gurtner | F41G 1/545 42/120 |
| 7,213,360 | B1 * | 5/2007 | Galloway | F41G 1/38 150/154 |
| 7,721,479 | B2 * | 5/2010 | Schulst | F41G 1/08 42/111 |
| 8,181,379 | B2 | 5/2012 | Brewer | |
| 8,240,076 | B2 * | 8/2012 | Carley | F41G 1/383 206/317 |

* cited by examiner

*Primary Examiner* — Reginald Tillman, Jr.

(57) ABSTRACT

A rifle scope protective covering includes a tubular sleeve that has a first end and a second end. The tubular sleeve has a cylindrical shape and has an inner surface and an outer surface and is comprised of a resiliently stretchable material. A distance between the inner surface and the outer surface is between 0.125 inches and 0.375 inches. The tubular sleeve is resiliently compressible from the outer surface to the inner surface. The tubular sleeve has a plurality of apertures extending therethrough. The tubular sleeve is stretched and slid onto a gun scope to frictionally engage and protect the gun scope from impact damage.

6 Claims, 2 Drawing Sheets

RIFLE SCOPE PROTECTIVE COVERING

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to gun scope protecting devices and more particularly pertains to a new gun scope protecting device for preventing damage to a gun scope while ensuring that the gun scope settings are not altered should the gun scope strike another object.

BRIEF SUMMARY OF THE INVENTION

An embodiment of the disclosure meets the needs presented above by generally comprising a tubular sleeve that has a first end and a second end. The tubular sleeve has a cylindrical shape and has an inner surface and an outer surface. The tubular sleeve is comprised of a resiliently stretchable material. A distance between the inner surface and the outer surface is between 0.125 inches and 0.375 inches. The tubular sleeve is resiliently compressible from the outer surface to the inner surface. The tubular sleeve has a plurality of apertures extending therethrough. The tubular sleeve is stretched and slid onto a gun scope to frictionally engage and protect the gun scope from impact damage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
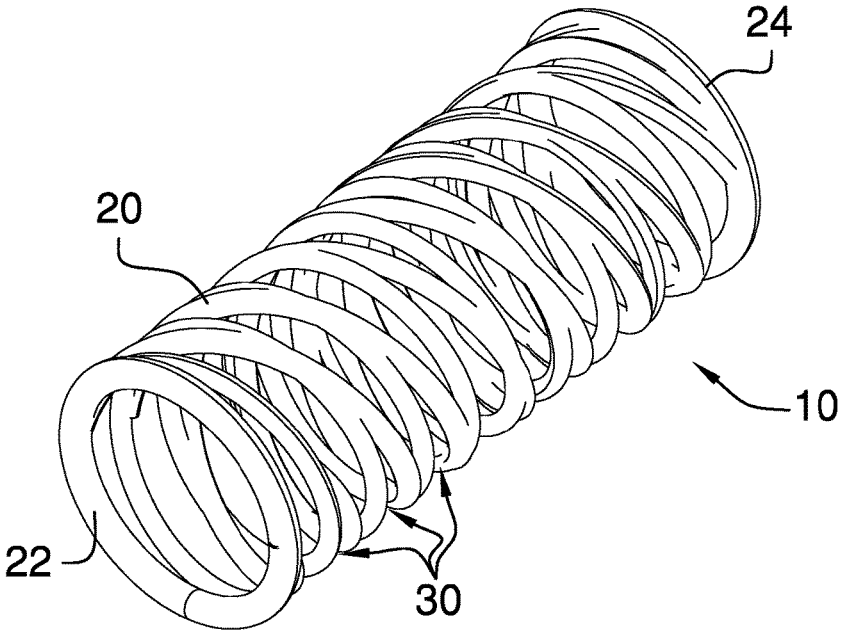
FIG. 1 is a front perspective view of a rifle scope protective covering according to an embodiment of the disclosure.
Figure 2:
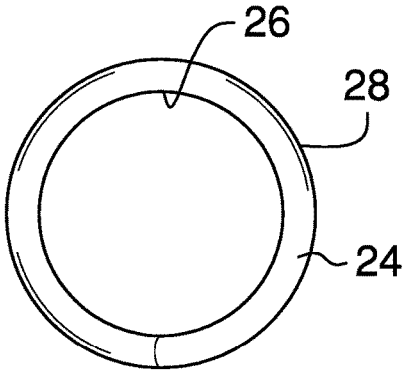
FIG. 2 is a rear view of an embodiment of the disclosure.
Figure 3:
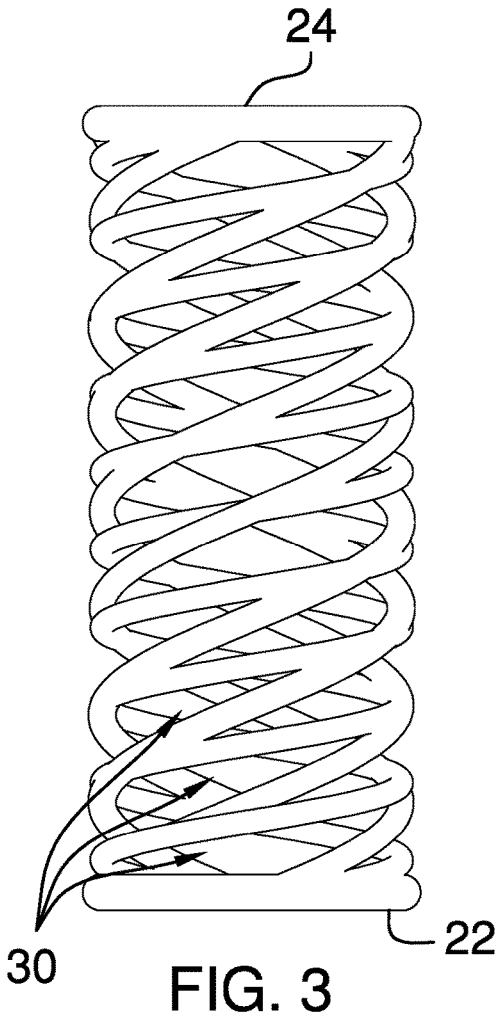
FIG. 3 is a top view of an embodiment of the disclosure.
Figure 4:
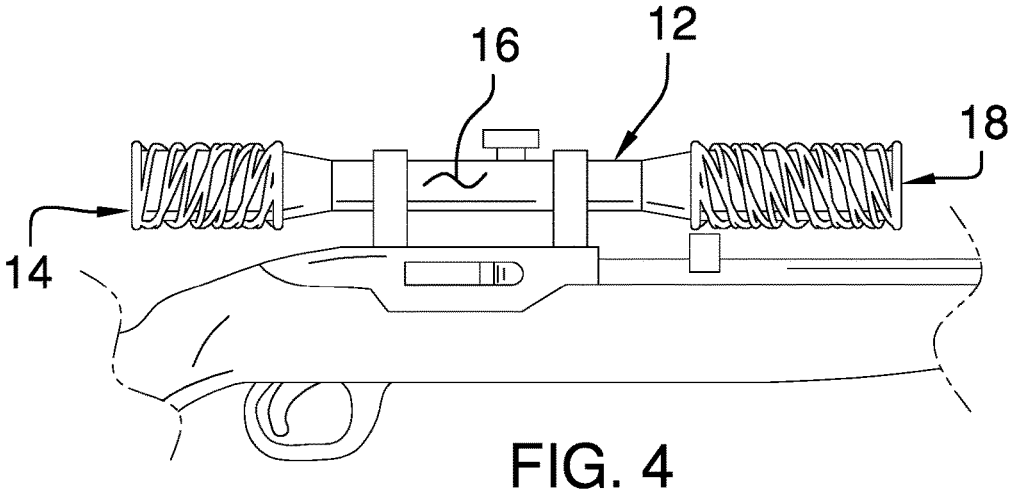
FIG. 4 is a side in-use view of an embodiment of the disclosure.

With reference now to the drawings, and in particular to FIGS. 1 through 4 thereof, a new gun scope protecting device embodying the principles and concepts of an embodiment of the disclosure and generally designated by the reference numeral 10 will be described.

As best illustrated in FIGS. 1 through 4, the rifle scope protective covering 10 generally comprises a device for protecting a conventional gun scope 12 having an eyepiece 14 and a perimeter wall 16. The eyepiece 14 is adjacent to an ocular lens and opposite an objective lens 18. Such gun scopes 12 are used on a variety of weapons but primarily on rifles and the like. As can be seen in the Figures and as would be understood by those skilled in the art of the gun scopes 12, the covering 10 may be provided in pairs with one used adjacent to the eyepiece and one used adjacent to the objective lens 18.

A tubular sleeve 20 is provided which is slid onto the gun scope 12 adjacent to the eyepiece 14 of the gun scope 12 such that the tubular sleeve 20 abuts the perimeter wall 16 of the gun scope 12. The tubular sleeve 20 has a first end 22 and a second end 24. The tubular sleeve 20 has a cylindrical shape and has an inner surface 26 and an outer surface 28. A diameter of the tubular sleeve 20 may vary depending on the gun scope 12 on which it is to be placed but typically will have an inner diameter between 0.75 inches and 2.5 inches. The tubular sleeve 20 is comprised of a resiliently stretchable material which may comprise a rubber that is either a natural rubber or a synthetic rubber such as a silicone rubber. A distance between the inner surface 26 and the outer 28 surface is between 0.125 inches and 0.375 inches. The tubular sleeve 20 is resiliently compressible from the outer surface 28 to the inner 26 surface. The tubular sleeve 20 further has a length from the first end 22 to the second end 24 between 2.0 inches and 12.0 inches and may be cut to length depending on the needs of the user of the covering 10.

A plurality of apertures 30 extends through the tubular sleeve 20 to provide an appearance which forms a web of intertwined helixes in the tubular sleeve. The apertures 30 are elongated and curvilinear having inner sections being wider that taper to their ends. This pattern allows for easy stretchability of the tubular sleeve while ensuring that it easily contours and frictionally grips the gun scope. Moreover, this structure prevents slippage between the tubular sleeve 20 and gun scope 12 since it will slightly twist with the gun scope optics and then pull the optics back where desired.

In use, the covering 10 is placed over the scope 12 to protect it from nicks, damage and being knocked which can alter the gun scope 12 settings. The tubular sleeve 20 will prevent the optics of the gun scope 12 from being rotated to ensure that the gun scope 12 is sighted in. The tubular sleeve also protects the gun scope 12 against shock damage should the rifle is it mounted on be dropped or otherwise strike another object.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A scope protecting assembly configured to be removably positioned on a gun scope to prevent damage to the gun scope, said assembly comprising:

a tubular sleeve having a first end and a second end, said tubular sleeve having a cylindrical shape and having an inner surface and an outer surface, said tubular sleeve being comprised of a resiliently stretchable material, a distance between said inner surface and said outer surface being between 0.125 inches and 0.375 inches, said tubular sleeve being resiliently compressible from said outer surface to said inner surface;

said tubular sleeve having a plurality of apertures extending therethrough such that said tubular sleeve forms a web of intertwined helixes wherein said tubular sleeve is configured for facilitating twisting of the gun scope while said tubular sleeve is engaged to said gun scope, each of said apertures being curvilinear having an inner section being wider and tapering towards opposite ends of said aperture; and wherein said tubular sleeve is configured to stretched and slid onto a gun scope to frictionally engage and protect the gun scope from impact damage.

2. The scope protecting assembly according to claim 1, wherein said tubular sleeve has a length from said first end to said second end between 2.0 inches and 12.0 inches.

3. The scope protecting assembly according to claim 1, wherein said resiliently stretchable material comprises a rubber material.

4. A scope protecting assembly configured to be removably positioned on a gun scope to prevent damage to the gun scope, said assembly comprising:

a tubular sleeve having a first end and a second end, said tubular sleeve having a cylindrical shape and having an inner surface and an outer surface, said tubular sleeve being comprised of a resiliently stretchable material, said resiliently stretchable material comprising a rubber material, a distance between said inner surface and said outer surface being between 0.125 inches and 0.375 inches, said tubular sleeve being resiliently compressible from said outer surface to said inner surface, said tubular sleeve having a length from said first end to said second end between 2.0 inches and 12.0 inches;

said tubular sleeve having a plurality of apertures extending therethrough such that said sleeve forms a web of intertwined helixes wherein said tubular sleeve is configured for facilitating twisting of the gun scope while said tubular sleeve is engaged to said gun scope, each of said apertures being curvilinear having an inner section being wider and tapering towards opposite ends of said aperture; and wherein said tubular sleeve is configured to stretched and slid onto a gun scope to frictionally engage and protect the gun scope from impact damage.

5. A method of protecting a gun scope providing the steps of:

providing a gun scope having an eyepiece; and providing a tubular sleeve being slid onto said gun scope adjacent to said eyepiece of the gun scope such that said tubular sleeve abuts an outer perimeter wall of the gun scope, said tubular sleeve having a first end and a second end, said tubular sleeve having a cylindrical shape and having an inner surface and an outer surface, said tubular sleeve being comprised of a resiliently stretchable material, a distance between said inner surface and said outer surface being between 0.125 inches and 0.375 inches, said tubular sleeve being resiliently compressible from said outer surface to said inner surface, said tubular sleeve having a plurality of apertures extending therethrough such that said sleeve forms a web of intertwined helixes wherein said tubular sleeve is configured for facilitating twisting of the gun scope while said tubular sleeve is engaged to said gun scope, each of said apertures being curvilinear having an inner section being wider and tapering towards opposite ends of said aperture.

6. The method of protecting a gun scope as in claim 5, wherein the step of providing said tubular sleeve further includes said tubular sleeve having a length from said first end to said second end between 2.0 inches and 12.0 inches.

* * * * *